US005967802A

United States Patent [19]

Daly et al.

[11] Patent Number: 5,967,802

[45] Date of Patent: Oct. 19, 1999

[54] ULTRA-LOW-PROFILE SCSI TERMINATOR

[75] Inventors: John Daly; Jaime Duran, both of Chicago, Ill.

[73] Assignee: Methode Electronics, Inc., Chicago, Ill.

[21] Appl. No.: 09/064,211

[22] Filed: Apr. 22, 1998

[51] Int. Cl.[6] ..... H01R 9/09

[52] U.S. Cl. ..... 439/76.1; 439/620

[58] Field of Search ..... 439/76.1, 620

[56] References Cited

U.S. PATENT DOCUMENTS

| | | | |
|---|---|---|---|
| 4,881,902 | 11/1989 | Papa et al. | 439/76.1 |
| 4,954,089 | 9/1990 | Jensen et al. | 439/620 |
| 5,286,221 | 2/1994 | Fencl et al. | 439/620 |
| 5,313,105 | 5/1994 | Samela et al. | 307/99 |
| 5,362,991 | 11/1994 | Samela | 327/540 |
| 5,472,348 | 12/1995 | Daly et al. | 439/76.1 |
| 5,507,654 | 4/1996 | Daly et al. | 439/76.1 |
| 5,563,559 | 10/1996 | Stephens et al. | 439/620 |
| 5,620,331 | 4/1997 | Los et al. | 439/404 |

*Primary Examiner*—Steven L. Stephan
*Assistant Examiner*—J. F. Duverne
*Attorney, Agent, or Firm*—David L. Newman; Karl D. Kovach

[57] ABSTRACT

An ultra-low-profile terminator apparatus for a parallel communications bus is provided. The terminator apparatus includes a male style electrical connector which includes a plurality of individual contact pins. An elongated printed circuit board having a first surface and a second surface is mounted perpendicular to the male connector. Conductive vias formed in the printed circuit board communicate between the first and second surfaces of the printed circuit board, and the contact pins of the male connector are press fit into the vias at the second surface of the printed circuit. Electronic termination components are mounted on the first surface of the printed circuit board, and the conductive vias form conductive paths between the termination components and individual contact pins in the male pin connector. The termination components are arranged on the first surface of the printed circuit board such that at least one of the termination component straddles the printed circuit board such that a first terminal is bonded to the printed circuit board at a first longitudinal side, and a second terminal is bonded to the printed circuit board at a second longitudinal side.

23 Claims, 5 Drawing Sheets

ULTRA-LOW-PROFILE SCSI TERMINATOR

BACKGROUND OF THE INVENTION

The present invention relates to an Ultra-Low-Profile Small Computer System Interface (SCSI) bus terminator. SCSI bus terminators are well known in the art. In small computer systems, a SCSI bus is employed to allow data communication between a CPU and peripheral devices such as disk drives, printers or other devices. Terminators are connected at each end of the bus to supply a matched termination impedance, and in the case of regulated terminators, to supply a constant voltage to the various signal lines comprising the bus.

Initially, SCSI terminators were purely passive devices. The most common terminator circuit comprised a 220 Ω resistor and a 330 Ω resistor connected in series between a +5 V termination power supply and ground, with the signal line being connected at the junction of the two resistors. Over time, improvements to the SCSI standard have been made, and several alternate termination circuits are now widely used. In addition to the passive 220/330 terminator, there are now regulated voltage terminators which incorporate a voltage regulator within the terminator apparatus and supply a regulated voltage directly to the signal lines through a 110 Ω termination resistor. There are also active terminators for use in SCSI systems employing active signal line deassertion (ADR), as well as passive low voltage differential terminators (LVD), and signal line increased current kicker terminators (SLICK®) which supply additional current to the ACK and REQ signal lines in order to avoid false data transitions. The various terminator circuits available today have specific advantages for particular applications, and the particular circuit employed will generally be dictated by the application.

Irrespective of which particular termination circuit is employed in a given SCSI application, the continued drive for miniaturization of computer components has created pressure to minimize the physical envelope taken up by SCSI terminators. Various packaging schemes have been devised to reduce the external dimensions of SCSI terminators generally. Both internal mount and external mount terminators have been developed in order to meet the space limitations imposed by the packaging requirements of the particular computer system into which a terminator is to be installed. Each type raises particular packaging demands which must be addressed in order to design an effective SCSI terminator. In general, an internal mount terminator will connect to a female connector header soldered to a printed circuit board. An external mount terminator will plug into an electrical connector mounted in a wall of the chassis of a computer or external peripheral device. While it is always desirable to reduce the overall dimensions of any terminator, the ever shrinking packaging of computer systems places the highest premium on reducing the space occupied by internal mount terminators.

Some common elements found in both internal and external mount terminators include a connector for connecting the terminator to the SCSI bus, a printed circuit board on which the various termination component are mounted, and a housing enclosing the terminator components. Often with internal mount terminators, a portion of the SCSI bus will be traced on the surface of a printed circuit board and each signal line will be soldered to a single pin within a connector header. The terminator's connector will connect to the header, and through the header connect the signal lines of the bus to the terminator printed circuit board. Often the printed circuit board on which the connector header is mounted will be near a wall of the chassis enclosing the device into which the terminator is to be mounted. In this case there will be very limited vertical space above the header in which to mount the terminator. (Note: the direction described here as "vertical" is completely arbitrary and could easily be replaced by any other direction depending on the orientation of the device). Due to this lack of vertical space, the terminator connecting to the header must have a very short height component.

A prior art terminator packaged to meet such requirements is shown in FIG. 1. The terminator package includes a male IDC connector 10 for connecting to a female connector header soldered to a printed circuit board which is not shown. The IDC connector 10 is connected to a first end of a short section of flexible ribbon cable 12, and the opposite end of the ribbon cable is joined to a male IDC ribbon header 14. The ribbon header 14 includes pins which are soldered to a horizontal printed circuit board located beneath a plastic cover 16. The printed circuit board beneath the cover contains the actual termination circuitry of the terminator which is connected to the various conductors of ribbon cable 12 via the male IDC header 14.

The prior art terminator of FIG. 1 presents a low vertical profile in that the height of the entire assembly is no greater than the height of the male IDC connector 10. Thus the device of FIG. 1 is well adapted for applications where a SCSI terminator is to be mounted within a device chassis where there is limited room between the SCSI bus header and a wall of the chassis or some other physical obstruction. A disadvantage with the FIG. 1 device, however, is that it is comprised of a fairly large number of component parts which must be individually assembled. The complexity of the componentry comprising the terminator has the undesirable effect of raising the manufacturing cost of the device. Another disadvantage with the device of FIG. 1 is that although low in profile, the entire assembly nonetheless occupies a significant amount of space albeit in a fairly low horizontal plane.

What is needed is a SCSI terminator having an improved ultra-low-profile which consumes no more vertical space than a typical IDC connector. Such a terminator package must be easily assembled, and include only a small number of individual parts. Furthermore, the improved terminator should be relatively inexpensive to manufacture and should consume only a minimal amount of space in the horizontal plane in addition to being low in profile. Finally, the improved terminator package should include a housing which is readily adapted for use as an external mount terminator which can be plugged directly into an exterior connector mounted on the outside of a SCSI device. The connector portion of the improved terminator should further be configured as a high density connector having either fifty or sixty-eight contact pins spaced on 0.050" centers.

SUMMARY OF THE INVENTION

In light of the prior art as described above, one of the main objectives of the present invention is to provide a communication bus terminator having an ultra-low vertical profile.

A further object of the present invention is to provide a Small Computer System Interface (SCSI) terminator having a vertical dimension which is no greater than the vertical dimension of a typical Insulation Displacement Connector (IDC).

Another objective of the present invention is to provide an ultra-low-profile SCSI terminator which includes a relatively low number of individually assembled components.

Still another objective of the present invention is to provide an ultra-low-profile SCSI terminator which is easily assembled and inexpensive to manufacture.

Yet another objective of the present invention is to provide an ultra-low-profile SCSI terminator which occupies a minimal amount of horizontal space.

An additional objective of the present invention is to provide an ultra-low-profile SCSI terminator which is easily adaptable for mounting both within the chassis of a computer device, or mounted external to the device.

All of these objectives, as well as others that will become apparent upon reading the detailed description of the presently preferred embodiment of the invention below, are met by the Ultra-Low-Profile SCSI Terminator as herein disclosed.

The ultra-low-profile terminator of the present invention is generally configured as a male high density male connector. In a preferred embodiment the male connector includes 50 contact pins in two parallel rows, with 0.05" spacing from center to center between adjacent contact pins in each row. Another similar embodiment requires 68 contact pins within the connector. An elongated printed circuit board is mounted above and perpendicular to the plurality of contact pins. The printed circuit board includes a plurality of conductive vias through the printed circuit board corresponding to the contact pins of the connector. Each conductive via is configured to receive one contact pin and convey electrical signals between the contact pin and circuitry mounted on the opposite side of the printed circuit board. The printed circuit board is formed having an increased cross sectional width such that the contact pins may be only partially inserted into the vias, and yet form a firm reliable interference/solder fit therewith without the contact pins extending all the way through the printed circuit board. Thus, the upper surface of the printed circuit board is unobstructed for mounting electronic components thereon. Termination components including such elements as flip chip termination resistors, and/or a voltage regulator, transistors, or any other termination components necessary to implement the particular termination scheme required by the particular application, are mounted on the upper surface of the printed circuit board. Because the male contact pins extending from the bottom surface of the printed circuit board do not extend all the way through to the upper surface of the printed circuit board, there is more area available on the upper surface of the printed circuit board for mounting the termination components in a space efficient manner.

A lower housing portion is provided including a horizontal base and a shroud depending therefrom. A plurality of holes corresponding to the number of contact pins extending from the printed circuit board are formed in the base and communicate with the space surrounded by the shroud. The contact pins may be fully inserted into the holes such that the printed circuit board rests flat against the base, and the contact pins extend into the space defined by the shroud, thereby forming a high density male connector configured to mate with a female header. The holes and pins are sized such that when inserted into the holes, the pins form a strong interference fit with the base forming a permanent connection between the printed circuit board and the base. A plastic cover is further provided to fit over the upper surface of the printed circuit board and engage the base to completely encase the termination circuitry within the terminator assembly. Clip structures on the cover engage a ridge formed around the perimeter of the base to releasably lock the cover in place.

Thus, an ultra-low-profile communication bus terminator is provided which includes a housing having a lower portion configured to engage a header assembly, wherein a printed circuit board having a first surface and a second surface is mounted to the housing. A plurality of contact pins extend into the lower portion of the housing to form an electrical connector. The printed circuit board further includes termination components mounted on the second surface of the printed circuit board wherein at least one termination component is mounted directly opposite at least one contact pin. This arrangement allows the termination components to be arranged in a space efficient manner such that the printed circuit board may be formed having a reduced surface area. Further, the vertical profile of the communication bus terminator is reduced to no more than the height of a typical IDC style male pin connector, and the horizontal space occupied by the terminator is also reduced. The terminator is assembled with a minimum of separate components, thereby reducing the manufacturing costs of the terminator.

DETAILED DESCRIPTION OF THE PRESENTLY PREFERRED EMBODIMENTS

The present invention relates to an ultra-low-profile communication bus terminator. In particular, the terminator package of the present invention is especially well adapted for terminating a Small Computer System Interface (SCSI) bus.

Figure 1:
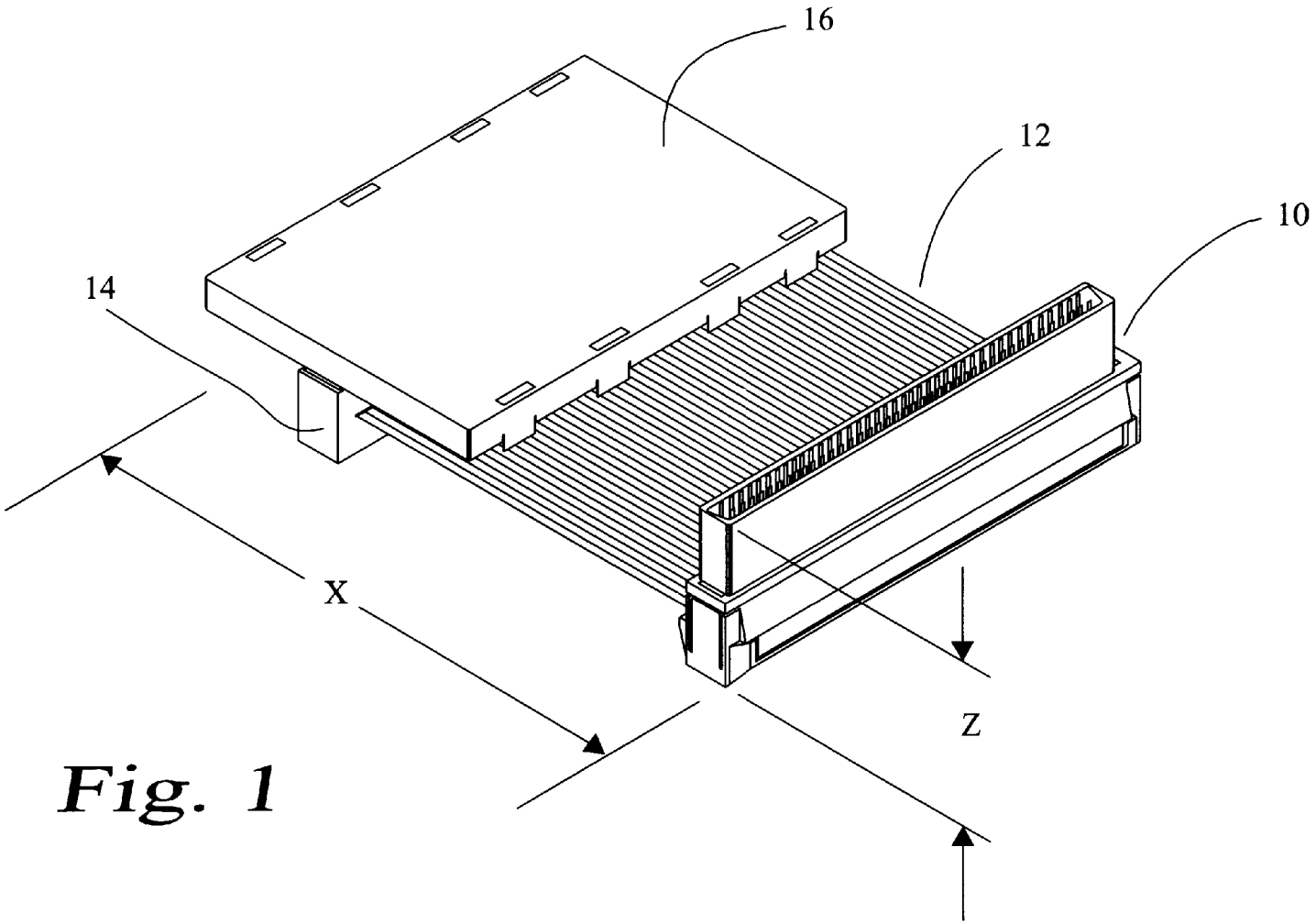
PRIOR ART Fig. 1
FIG. 1 is an isometric view of a prior art low profile SCSI terminator.
Figure 2:
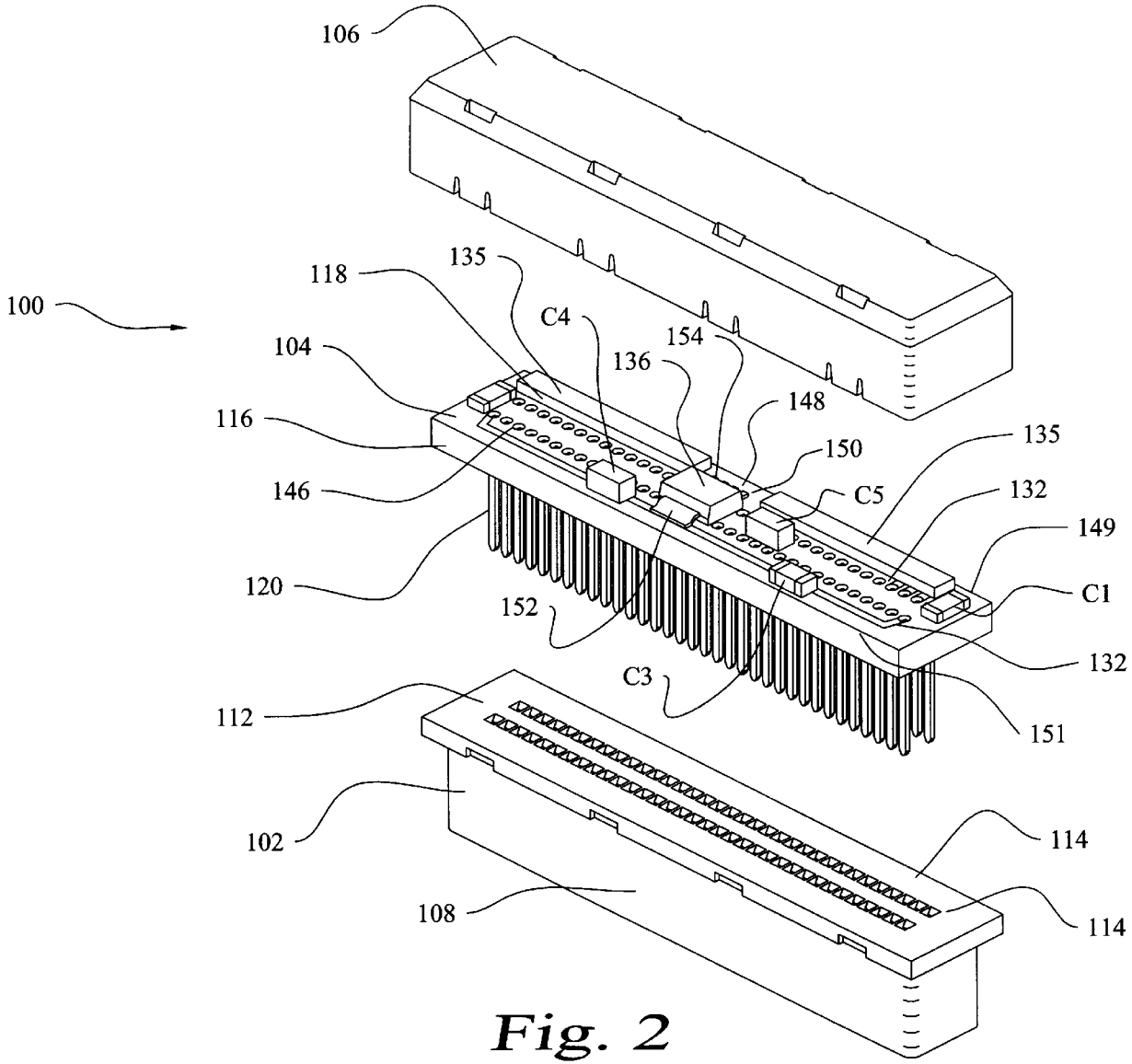
FIG. 2 is an exploded isometric view looking down on the top of an ultra-low-profile terminator according to the present invention.
Figure 3:
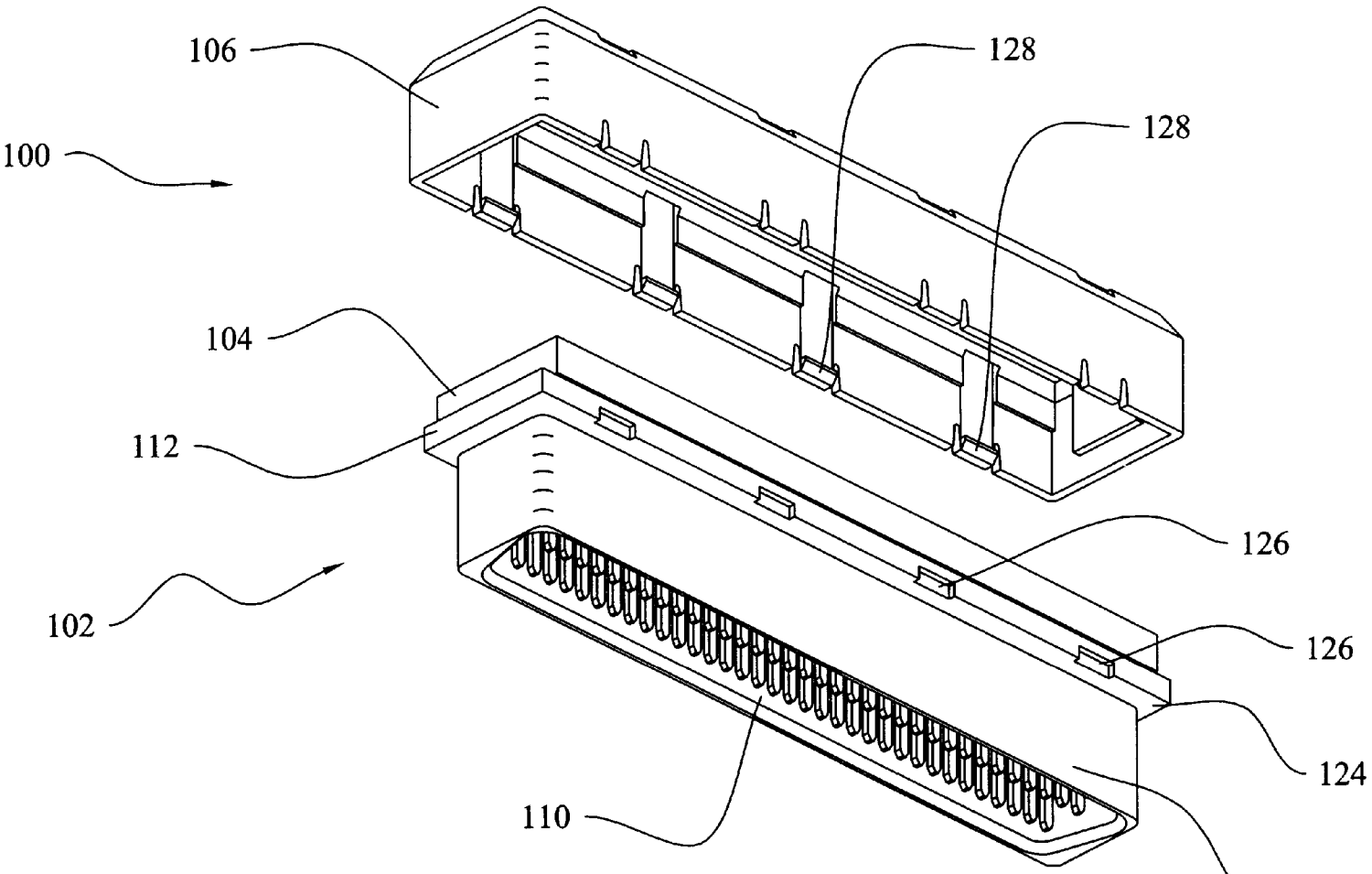
FIG. 3 is an isometric view of the same assembly as FIG. 2 looking up from the bottom of the assembly.

Tuning to FIGS. 2 and 3 of the attached drawings, the major components of an ultra-low-profile SCSI terminator assembly 100 are shown in exploded isometric view in FIG. 2, and in assembled isometric view showing the bottom side of the assembly in FIG. 3. The assembly includes a lower housing portion 102, a printed circuit board 104 and a cover 106. Included with the lower housing portion 102 is a shroud 108 encircling a D shaped space 110 configured to receive a mating connector or header assembly. Above the shroud is a horizontal base 112 which extends across the lower housing portion 102. The base 112 includes a multiplicity of holes 114 communicating with the space 110 surrounded by the shroud 108. The printed circuit board 104 includes a first surface 116 and a second surface 118, with a plurality of contact pins 120 extending perpendicular from the first surface. Various termination components are mounted to the second surface 118. Finally, the cover 106 is configured to fit over the printed circuit board 104 and enclose the terminator apparatus 100. The base 112 forms a ridge 124 around the perimeter of the lower housing portion 102. The ridge includes a number of latch receiving indentations 126 configured to receive corresponding resilient locking latches 128 formed along the opening to cover 106.

When the terminator apparatus 100 is assembled, the individual contact pins 120 extending from the first surface 116 of the printed circuit board 104 are aligned with the plurality of holes 114 formed in the base 112 of the lower housing portion 102, and inserted therein. The width of the individual holes 114 and the corresponding width of the contact pins 120 are such that the holes form a very tight interference fit with the contact pins. The contact pins 120 are pressed into the holes until the printed circuit board 104 lies flat against the base 112 of the lower housing portion. In this arrangement the contact pins 120 extend into the space 110 defined by the shroud, thereby forming a male pin style electrical connector configured to mate with a corresponding female pin connector, or header assembly (mating connector not shown). The press fit connection formed between the holes 114 and the contact pins 120 acts to securely attach the printed circuit board 104 to the lower housing portion 102. A layer of epoxy may be added between the base and the printed circuit board to form a more secure bond between the printed circuit board 104 and the base 112. Finally, the cover 106 is placed over the printed circuit board 104 and forced over the ridge 124 surrounding the base 112 of the lower housing portion 102. The ridge 124 forces the resilient latches 128 outward until the latches are adjacent the latch receiving indentations 126, at which point the latches flex back to their normal position with the latches overlapping the underside of the latch receiving indentations, thereby locking the cover 106 in place over the printed circuit board 104.

Figure 4:
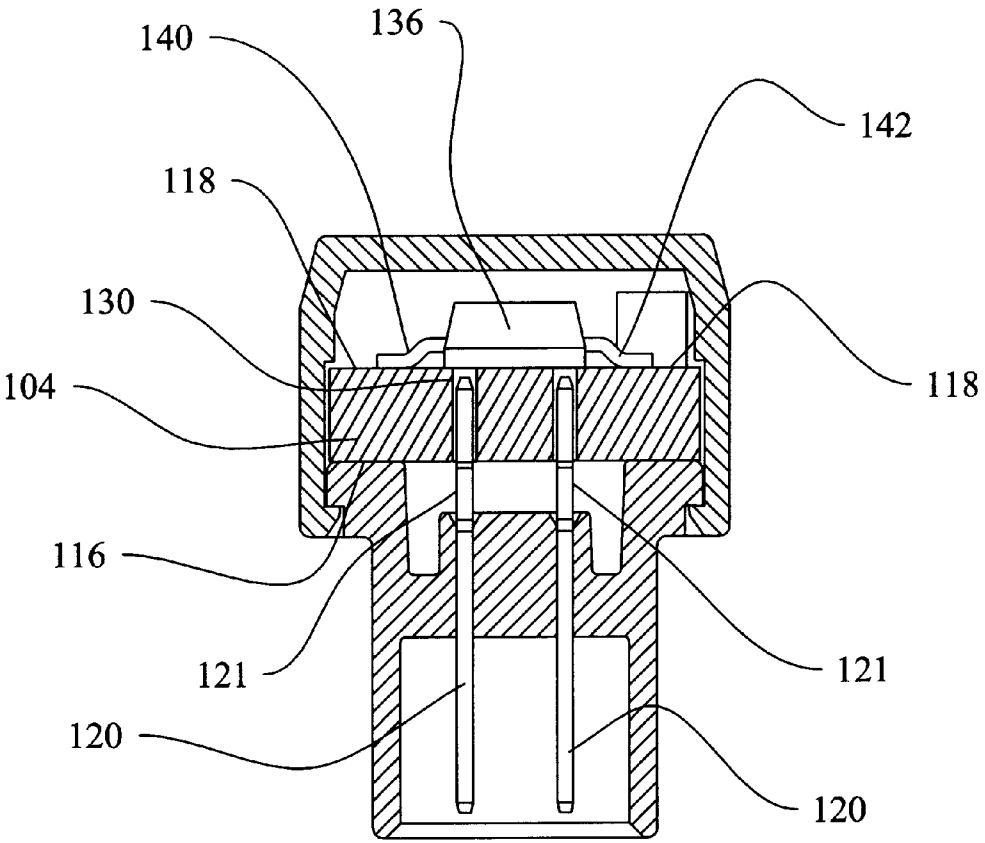
FIG. 4 is a cross sectional view of the terminator assembly of FIG. 2.
Figure 5:
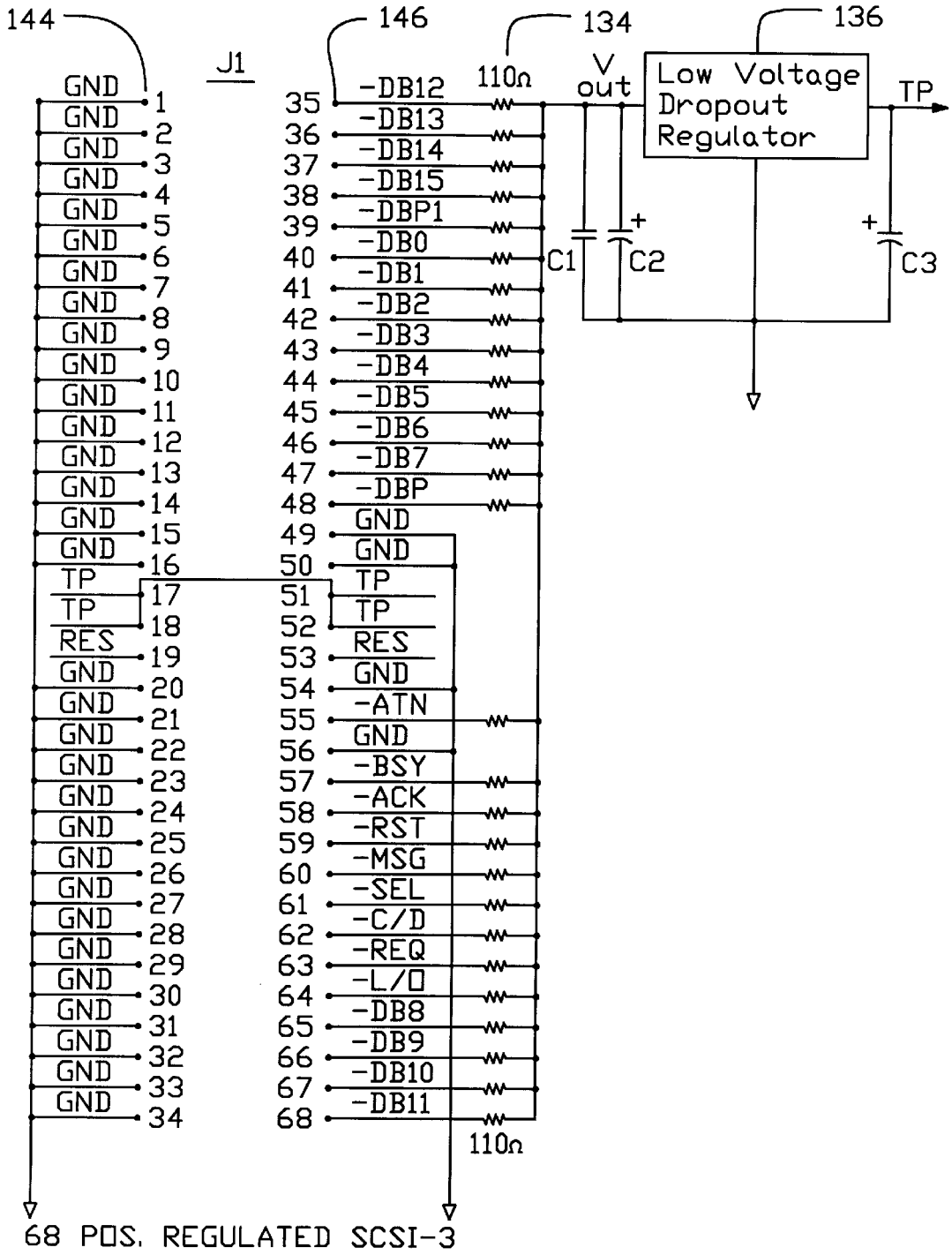
FIG. 5 is a schematic diagram of a regulated voltage SCSI terminator according to a preferred embodiment of the invention.

Referring now to FIGS. 4 and 5, there are significant design features which should be considered which allow the terminator apparatus of the present invention to be constructed with a particularly low vertical profile without consuming a particularly large amount of horizontal space. Included among these features is a printed circuit board 104 having a greater vertical thickness than is typical with most standard printed circuit boards. For example, in a preferred embodiment the printed circuit board 104 has a thickness of 0.093." The significance of the thicker printed circuit board is in the attachment configuration of the contact pins 120 to the printed circuit board 104. A plurality of conductive vias 130 are formed through the width of the printed circuit board, with the number of conductive vias corresponding to the number of contact pins 120 to be attached to the printed circuit board. Each conductive via 130 comprises an aperture through the printed circuit board, with the inner diameter of the apertures coated or plated with a conductive material. Each corresponding contact pin 120 is then press fit and soldered into a corresponding via. However, as can be seen in the cross section of FIG. 4, the contact pins 120 are only partially inserted into the vias 130. A wider flared portion of the contact pins 121 prevents the pins from being inserted all the way through the board, and ensures that all of the pins are soldered at a uniform depth relative to the printed circuit board. Because the printed circuit board has additional thickness, the contact pins 120 may form a tight, solid press fit with the inner diameter of the vias such that when soldered, the contact pins will be retained by the printed circuit board 104 without the pins extending beyond the second surface 118 of the printed circuit board. Thus, the second surface 118 of the printed circuit board is unobstructed by the upper ends of the contact pins. This allows some of the termination components to be mounted on the second surface of the printed circuit board directly across from one or more contact pins 120. Meanwhile, the conductive vias 130 provide an electrical connection between the individual contact pins 120 and conductive traces 132 formed on the second surface of the printed circuit board. The conductive traces in turn, connect the conductive vias to the various termination components mounted on the printed circuit board.

The arrangement described above is exemplified in the cross section view of FIG. 4. There, a pair of contact pins 120 are shown partially inserted into two conductive vias 130. Furthermore, a voltage regulator 136 is mounted on the second surface 118 of the printed circuit board 104 directly across from the two contact pins 120. As shown in the drawing, a first lead 140 is attached at a first longitudinal side of the printed circuit board, and a second lead 142 is mounted at a second longitudinal side of the printed circuit board with the voltage regulator 136 itself straddling the printed circuit board 104. This particular arrangement is only possible because the second surface 118 of the printed circuit board 104 is unobstructed by the upper ends of the contact pins 120. The possibility of mounting termination components on the second surface 118 directly across from the contact pins allows the termination components to be laid out in a more space efficient manner which conserves large amounts of printed circuit board real estate.

A plan view of such of a preferred layout of the termination components for a regulated terminator according to the present invention can be seen in FIG. 2. The schematic diagram of the preferred termination circuit embodied in FIG. 2 is shown in FIG. 5. It should be noted that the preferred termination circuit of FIG. 5 represents a regulated SCSI terminator, however, the scope of the present invention is not limited to regulated SCSI terminators. The packaging arrangement included as one aspect of the present invention is readily adaptable to other termination circuits, and may be employed on communications buses other than SCSI, as well as other SCSI termination circuits such as LVD, ADR, SLICK®, or others as outlined in the background of the invention. In the preferred embodiment of FIGS. 2 and 5, first and second rows of conductive vias 144, 146 correspond to first and second rows of contact pins mounted on the opposite side of the printed circuit board. The physical location of the vias on printed circuit board 104 roughly correspond to their location in the schematic representation of FIG. 5. Positions 1–16 and 20–34 are connected to ground pins, and the vias associated with these positions are all connected to a common electrical ground. Positions 35–50, 55, and 57–68 represent the various signal lines. The contact pins in these positions are connected to the various signal lines of the SCSI bus when inserted into a contact header attached to the SCSI bus. The vias associated with these pins are each connected to separate 110 Ω resistors 134 and the resistors are driven by a regulated 2.85 V voltage supplied by a voltage regulator 136. The +5 V termpower is supplied by the SCSI bus through pins 17, 18, 51, and 52 which are all electrically connected. Finally, positions 50, 54, and 56 are also connected to ground, and positions 19 and 53 are left unconnected.

On the printed circuit board 104 itself, the 110 Ω resistors connected to the signal line vias are formed as polymer thick film resistors adhered directly to the surface of the printed circuit board, or as "flip-chip" resistors adhered to the surface of a separate ceramic (cermet) substrate 135 as shown in FIG. 2. Such polymer thick film resistors and flip-chip resistors occupy a very small space and thus are ideal for providing an accurate and reliable resistance without consuming a large amount of real estate on the printed circuit board. A further advantage of flip-chip resistors in the embodiment shown, is that the cermet substrates act as radiators to remove heat generated by the voltage regulator 136. A narrow conductive trace 148 along a first longitudinal edge 149 of the printed circuit board 104 connects the common side of the 110 Ω resistors to the output lead 150 of the 2.85 V voltage regulator 136. Capacitors $C_1$ and $C_2$ located at the extreme ends of the printed circuit board and $C_3$ located near the center of the board connect the output of the voltage regulator to ground. $C_1$, $C_2$ and $C_3$ act as high frequency bypass capacitors, providing a direct path to ground for any high frequency noise that may be present on the bus. Capacitor $C_4$ also connects the output of the voltage regulator 136 to ground, and capacitor $C_5$ connects the +5 V termpower to ground. $C_4$ is located along the second longitudinal side 151 of printed circuit board 104 similar to $C_3$, while $C_5$ is wedged between the two parallel rows of conductive vias. Finally, the voltage regulator 136 is mounted across the transverse width of the printed circuit board 104. A ground lead 152 is soldered to the printed circuit board near the second longitudinal edge 151, and the voltage regulator itself spans nearly the entire central region of the printed circuit board. The input power lead 154 and the output voltage lead 150 extend from the voltage regulator on the side opposite the ground lead 152, and are soldered along the first longitudinal side 149 of the printed circuit board. Thus, the voltage regulator is mounted on the upper surface 118 of printed circuit board 104, directly across from a plurality of contact pins 120 extending from the lower side 116 of the printed circuit board 104.

Clearly, this arrangement allows the printed circuit board to be smaller than would otherwise be possible. Due to the relatively large size of the voltage regulator 136, the surface area of the printed circuit board would necessarily have to be increased in order to accommodate the regulator if it were not possible to span the conductive vias connected to the contact pins mounted beneath the regulator. Thus, in this arrangement, the printed circuit board does not consume a great deal of space in the horizontal plane. Furthermore, since the printed circuit board 104 is mounted perpendicular to the connector pins 120, the vertical space occupied by the terminator is reduced to an absolute minimum. The terminator of the preferred embodiment just described has the further advantage that it is comprised of very few individual components and is easily assembled. First, the printed circuit board may be manufactured using well known mass production techniques, then the board can be mounted to the lower housing portion 102 by inserting the contact pins 120 into the corresponding holes 114 formed in the base. Finally, the cover is placed over the printed circuit board and the clips fastened to the ridge 124 formed along the base 112. Thus, the terminator apparatus of the present invention is easy to assemble, inexpensive to manufacture, and presents an ultra-low-profile for use in environments wherein the space occupied by the terminator must be kept to a minimum. Furthermore, the plastic cover and the plastic lower base portion can be metallized by adding material having conductive properties to the resins used to form these components. By metallizing the housing and cover, the terminator apparatus herein disclosed may also be employed in applications where it is necessary to mount the communication bus terminator outside the computer device chassis. In these cases, the metallized housing shields the signals from externally generated electromagnetic interference, as well as preventing emissions from the terminator itself from interfering with other equipment operating near the device.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An ultra-low-profile communication bus terminator comprising:

a housing having a lower portion configured to engage a contact header assembly;

a printed circuit board having a first surface and a second surface, the printed circuit board mounted to the housing;

a plurality of contact pins mounted within the printed circuit board and extending from the printed circuit board first surface, and arranged to protrude into the lower portion of the housing, thereby forming an electrical connector; and a plurality of termination components mounted on the second surface of the printed circuit board, at least one of said termination components being surface mounted to the printed circuit board directly over and across from at least one contact pin, and wherein the second surface of the printed circuit board has a substantially smooth, planar and unobstructed surface prior to mounting of the termination components thereon.

2. The bus terminator of claim 1 further comprising a plurality of conductive vias formed within the printed circuit board communicating between the first and second surfaces thereof.

3. The bus terminator of claim 2 wherein the plurality of contact pins are individually partially press fit and soldered into the plurality of vias such that an upper end of the contact pins does not extend beyond the second surface of the printed circuit board.

4. The bus terminator of claim 1 wherein the termination components include termination resistors comprising polymer thick film resistors adhered to the second surface of the printed circuit board.

5. The bus terminator of claim 1 wherein the termination components include flip-chip resistors adhered to a ceramic substrate mounted on the printed circuit board.

6. The bus terminator of claim 5 wherein the termination components further include a voltage regulator which is mounted on the second surface of the printed circuit board opposite at least one of the contact pins.

7. The bus terminator of claim 1 wherein the plurality of contact pins are arranged in multiple parallel rows of contact pins, and wherein the lower portion of the housing is configured as a high density male pin electrical connector.

8. The bus terminator of claim 7 wherein the individual contact pins within each parallel row of contact pins are spaced apart 0.05 inches from the center of a first contact pin to the center of an adjacent contact pin.

9. A terminator apparatus for a Small Computer System Interface bus comprising:

a male pin electrical connector including a plurality of contact pins;

an elongated printed circuit board having a first surface and a second surface perpendicularly mounted to a ribbon style connector;

a plurality of conductive vias formed in the printed circuit board communicating between the first and second surfaces, the contact pins of the male pin connector being mounted in the vias at the second surface of the printed circuit and not protruding through to the first surface, and the first surface being planar and unobstructed; and termination components mounted on the planar and unobstructed first surface of the printed circuit board, the conductive vias forming conductive paths between the termination components and individual contact pins in the male pin connector, the termination components being arranged on the first surface such that at least one component is surface mounted and straddles the printed circuit board so as to be directly over and across from at least one of the contact pins, the at least one component having a first terminal bonded to the printed circuit board at a first longitudinal side, and a second terminal bonded at a second longitudinal side.

10. The terminator apparatus of claim 9 wherein the termination components comprise a plurality of polymer thick film resistors.

11. The terminator apparatus of claim 10 wherein the termination components further comprise polymer thick film resistors having resistance of approximately 110 Ω.

12. The terminator apparatus of claim 10 wherein the termination components further comprise a voltage regulator.

13. The terminator apparatus of claim 12 wherein the voltage regulator is configured to supply 2.85 V to the bus.

14. The terminator apparatus of claim 9 wherein the male pin connector comprises a 50 pin connector.

15. The terminator apparatus of claim 9 wherein the male pin connector comprises a 68 pin connector.

16. The terminator apparatus of claim 9 wherein the male pin connector comprises a high density connector having two parallel rows of contact pins wherein the contact pins are spaced apart on 0.050 inch centers.

17. A terminator assembly comprising:

a male high density connector having a plurality of contact pins;

a printed circuit board having an upper surface and a lower surface, the printed circuit board being transverse mounted to the male pin connector;

termination circuitry mounted on the upper surface of the printed circuit board;

conductive vias formed in the printed circuit board connecting the termination circuitry to the contact pins mounted in the vias of the connector so that the upper surface remains planar and unobstructed, and wherein the termination circuitry includes a termination component mounted directly to the upper surface over and across from at least one of the vias;

a cover enclosing the printed circuit board; and the terminator assembly having a height dimension less than 0.75 inches, and a width dimension less than 0.5 inches.

18. The terminator assembly of claim 17 wherein said termination circuitry further comprises a plurality of thick film resistors having a resistive value of approximately 110 Ω.

19. The terminator assembly of claim 18 wherein said termination circuitry further comprises a voltage regulator having a first terminal bonded to the upper surface of the printed circuit board at a first longitudinal side thereof, and a second terminal bonded to the upper surface of the printed circuit board at a second longitudinal side thereof.

20. The terminator assembly of claim 19 further comprising conductive vias formed within the printed circuit board communicating between the upper and lower surfaces thereof, the male pin connector contact pins being press fit into said vias and protruding perpendicular to the lower surface of the printed circuit board, the conductive vias electrically connecting the contact pins to the termination circuitry.

21. The terminator assembly of claim 20 wherein the male pin connector comprises a 50 position high density connector two parallel rows of contact pins spaced on 0.050 inch centers.

22. The terminator assembly of claim 20 wherein the male pin connector comprises a 68 position high density connector two parallel rows of contact pins spaced on 0.050 inch centers.

23. The terminator assembly of claim 17 wherein the contact pins comprise a contact end for engaging a mating connector, and a terminal end for mounting within the conductive vias, the terminal end being divided from the contact end by a wider flared portion which engages the printed CKT board to the contact pins from being inserted completely through the printed circuit board.

* * * * *